US006559107B2

(12) United States Patent
Nalesnik

(10) Patent No.: US 6,559,107 B2
(45) **Date of Patent: *May 6, 2003**

(54) THIADIAZOLIDINE ADDITIVES FOR LUBRICANTS

(75) Inventor: Theodore E. Nalesnik, Hopewell Junction, NY (US)

(73) Assignee: Crompton Corporation, Middlebury, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/871,302

(22) Filed: May 31, 2001

(65) Prior Publication Data

US 2002/0193258 A1 Dec. 19, 2002

(51) Int. Cl.[7] ..... C10M 133/44; C10M 133/48
(52) U.S. Cl. ..... 508/272; 508/277; 508/279
(58) Field of Search ..... 508/272, 277, 508/279

(56) References Cited

U.S. PATENT DOCUMENTS

| | | | | |
|---|---|---|---|---|
| 3,293,181 | A | 12/1966 | Stuart et al. | 252/32.7 |
| 3,396,109 | A | 8/1968 | Butler et al. | 252/32.7 |
| 3,397,145 | A | 8/1968 | Cyba et al. | 252/32.7 |
| 3,442,804 | A | 5/1969 | LeSuer et al. | 252/32.7 |
| 3,474,108 | A | 10/1969 | Heugebaert et al. | 260/294.8 |
| 3,637,499 | A | 1/1972 | Pollak | 252/32.7 |
| 5,084,195 | A | 1/1992 | Camenzind et al. | 252/47.5 |
| 5,300,243 | A | 4/1994 | Camenzind et al. | 252/47.5 |
| 5,498,809 | A | 3/1996 | Emert et al. | 585/13 |
| 5,512,190 | A | 4/1996 | Anderson et al. | 252/47 |
| 5,514,189 | A | 5/1996 | Farng et al. | 44/383 |

FOREIGN PATENT DOCUMENTS

| | | |
|---|---|---|
| DE | 1260137 | 5/1967 |
| JP | 03140346 | 6/1991 |

*Primary Examiner*—Jerry D. Johnson
(74) *Attorney, Agent, or Firm*—Daniel Reitenbach; Paul Grandinetti

(57) ABSTRACT

Disclosed herein is a composition comprising:

(A) a lubricant, and (B) at least one 5-alkyl-2-thione-1,3,4-thiadiazolidine compound of the formula:

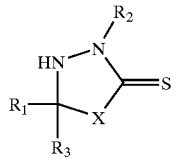

wherein $R_1$ is a hydrocarbon or functionalized hydrocarbon of from 1 to 30 carbon atoms, $R_2$ and $R_3$ are independently selected from the group consisting of hydrocarbon or functionalized hydrocarbons of from 1 to 30 carbon atoms and hydrogen, and X is oxygen, sulfur or nitrogen.

25 Claims, No Drawings

THIADIAZOLIDINE ADDITIVES FOR LUBRICANTS

BACKGROUND OF THE INVENTION

1. Field of the Invention

This invention is related to lubricants, especially lubricating oils, and, more particularly, to a class of ashless and non-phosphorus-containing anti-wear, anti-fatigue, and extreme pressure additives derived from 5-alkyl-2-thione-1,3,4-thiadiazolidines.

2. Description of Related Art

In developing lubricating oils, there have been many attempts to provide additives that impart antifatigue, antiwear, and extreme pressure properties thereto. Zinc dialkyldithiophosphates (ZDDP) have been used in formulated oils as antiwear additives for more than 50 years. However, zinc dialkyldithiophosphates give rise to ash, which contributes to particulate matter in automotive exhaust emissions, and regulatory agencies are seeking to reduce emissions of zinc into the environment. In addition, phosphorus, also a component of ZDDP, is suspected of limiting the service life of the catalytic converters that are used on cars to reduce pollution. It is important to limit the particulate matter and pollution formed during engine use for toxicological and environmental reasons, but it is also important to maintain undiminished the antiwear properties of the lubricating oil.

In view of the aforementioned shortcomings of the known zinc and phosphorus-containing additives, efforts have been made to provide lubricating oil additives that contain neither zinc nor phosphorus or, at least, contain them in substantially reduced amounts.

Illustrative of non-zinc, i.e., ashless, non-phosphorus-containing lubricating oil additives are the reaction products of 2,5-dimercapto-1,3,4-thiadiazoles and unsaturated mono-, di-, and tri-glycerides disclosed in U.S. Pat. No. 5,512,190 and the dialkyl dithiocarbamate-derived organic ethers of U.S. Pat. No. 5,514,189.

U.S. Pat. No. 5,512,190 discloses an additive that provides antiwear properties to a lubricating oil. The additive is the reaction product of 2,5-dimercapto-1,3,4-thiadiazole and a mixture of unsaturated mono-, di-, and triglycerides. Also disclosed is a lubricating oil additive with antiwear properties produced by reacting a mixture of unsaturated mono-, di-, and triglycerides with diethanolamine to provide an intermediate reaction product and reacting the intermediate reaction product with 2,5-dimercapto-1,3,4 thiadiazole.

U.S. Pat. No. 5,514,189 discloses that dialkyl dithiocarbamate-derived organic ethers have been found to be effective antiwear/antioxidant additives for lubricants and fuels.

U.S. Pat. Nos. 5,084,195 and 5,300,243 disclose N-acyl-thiourethane thioureas as antiwear additives specified for lubricants or hydraulic fluids.

The disclosures of the foregoing references are incorporated herein by reference in their entirety.

SUMMARY OF THE INVENTION

The present invention relates to compounds of the formula

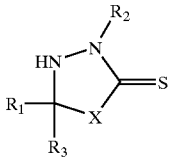

wherein $R_1$ is a hydrocarbon or functionalized hydrocarbon of from 1 to 30 carbon atoms, $R_2$ and $R_3$ are independently selected from the group consisting of hydrocarbon or functionalized hydrocarbons of from 1 to 30 carbon atoms and hydrogen, and X is oxygen, sulfur or nitrogen.

In the above structural formulas, $R_1$, $R_2$, and $R_3$ can be a straight or branched chain, fully saturated or partially unsaturated, hydrocarbon moiety, preferably alkyl or alkenyl having from 1 to 30 carbon atoms, e.g., methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, oleyl, nonadecyl, eicosyl, heneicosyl, docosyl, tricosyl, tetracosyl, pentacosyl, triacontyl, ethenyl, propenyl, butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl, octadecenyl, oleenyl, nonadecenyl, eicosenyl, heneicosenyl, docosenyl, tricosenyl, tetracosenyl, pentacosenyl, triacontenyl, and the like, and isomers and mixtures thereof. Additionally, $R_1$, $R_2$, and $R_3$ can be a straight or branched chain, a fully saturated or partially unsaturated hydrocarbon chain, preferably having from 1 to 40 carbon atoms, which may contain within it ester groups or heteroatoms, such as, oxygen, sulfur, and nitrogen, which may take the form of ethers, polyethers, sulfides, amines, and amides. This is what is meant by "functionalized hydrocarbon."

The 5-alkyl-2-thione-1,3,4-thiadiazolidine compounds of this invention are useful as ashless, non-phosphorus-containing antifatigue, antiwear, extreme pressure additives for lubricating oils.

The present invention also relates to lubricating oil compositions comprising a lubricating oil and a functional property-improving amount of at least one 5-alkyl-2-thione-1,3,4-thiadiazolidine compound of the above formulas. More particularly, the present invention is directed to a composition comprising:

(A) a lubricant, and (B) at least one 5-alkyl-2-thione-1,3,4-thiadiazolidine compound of the formula:

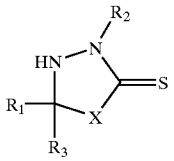

wherein $R_1$ is a hydrocarbon or functionalized hydrocarbon of from 1 to 30 carbon atoms, $R_2$ and $R_3$ are independently selected from the group consisting of hydrocarbon or functionalized hydrocarbons of from 1 to 30 carbon atoms and hydrogen, and X is oxygen, sulfur or nitrogen.

It is preferred that the 5-alkyl-2-thione-1,3,4-thiadiazolidine is present in the compositions of the present invention in a concentration in the range of from about 0.01 to about 10 wt %.

DESCRIPTION OF THE PREFERRED EMBODIMENTS

The 5-alkyl-2-thione-1,3,4-thiadiazolidine compounds of the present invention are compounds of the formula:

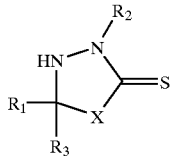

wherein $R_1$ is a hydrocarbon or functionalized hydrocarbon of from 1 to 30 carbon atoms, $R_2$ and $R_3$ are independently selected from the group consisting of hydrocarbon or functionalized hydrocarbons of from 1 to 30 carbon atoms and hydrogen, and X is oxygen, sulfur or nitrogen.

In the above structural formula, $R_1$, $R_2$, and $R_3$ are preferably an alkyl moiety of 1 to 30 carbon atoms, more preferably of 1 to 22 carbon atoms, most preferably of 1 to 10 carbon atoms, and can have either a straight chain or a branched chain, a fully saturated or partially unsaturated hydrocarbon chain, e.g. methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, oleyl, nonadecyl, eicosyl, heneicosyl, docosyl, tricosyl, tetracosyl, pentacosyl, triacontyl, pentatriacontyl, tetracontyl, and the like, and isomers, e.g., 1-ethylpentyl, and mixtures thereof Where $R_1$, $R_2$, and/or $R_3$ are alkyl, they can be either a straight or a branched hydrocarbon chain, a fully saturated or partially unsaturated hydrocarbon chain, an alkylaryl, wherein said chains may contain ester groups or heteroatoms, such as oxygen and/or sulfur and/or nitrogen, which may take the form of ethers, polyethers, sulfides, amines, amides, and the like. As employed herein, the term "alkyl" is also intended to include "cycloalkyl." Where the alkyl is cyclic, it preferably contains from 3 to 9 carbon atoms, e.g., cyclopropyl, cyclobutyl, cyclopentyl, cyclohexyl, cycloheptyl, cyclooctyl, cyclononyl, and the like. Cycloalkyl moieties having 5 or 6 carbon atoms, i.e., cyclopentyl or cyclohexyl, are more preferred.

Additionally, $R_1$ and $R_3$ can be fused together as part of a spiro cyclic alkyl group $CH_2(CH_2)_nCH_2$, where n=1–4.

The use of the 5-alkyl-2-thione-1,3,4-thiadiazolidine compounds of this invention can improve the antifatigue, antiwear, and extreme pressure properties of a lubricant.

GENERAL SYNTHESIS OF ADDITIVES OF THIS INVENTION

The 5-alkyl-2-thione-1,3,4-thiadiazolidine compounds of the present invention can be synthesized as follows.

PROCEDURE A

In a 500 mL round bottom three-neck reaction flask equipped with a reflux condenser, mechanical stirrer, thermocouple, and nitrogen blanket is charged 100 mL of hexane solvent. The solvent can be any other liquid that is chemically inert towards the reactants and products that is also capable of azeotroping water, such as heptane, toluene, and xylenes. To the solvent is added aldehyde or ketone (0.5 mole). Methylhydrazine (0.5 mole) is then added dropwise over a one hour period to the hexane/aldehyde (or ketone) solution, with added cooling as a result of the occurring exotherm. The reaction media are then gently refluxed for a one hour period. The reflux condenser is then replaced with a Dean-Stark water trap to collect the water by-product. After the theoretical amount of water has been collected, the reaction media are cooled to 25° C. Carbon disulfide(0.5 mole) is then added dropwise over a one hour period with external cooling to maintain the exothermic reaction temperature below 35° C. After the carbon disulfide addition is complete, the temperature is raised to reflux or 115° C. and held for one hour. The solvent is then removed under vacuum. The product may then be polish filtered through a bed of Celite filter aid.

PROCEDURE B

In a 500 mL round bottom three-neck reaction flask equipped with a reflux condenser, mechanical stirrer, thermocouple, and nitrogen blanket is charged 100 mL of hexane solvent. The solvent can be any other liquid chemically inert towards the reactants and products that is also capable of azeotroping water, such as heptane, toluene and xylenes. To the solvent is added rnethylhydrazine (0.5 mole). An aldehyde or ketone (0.5 mole) is then added dropwise over a one hour period to the hexane/hydrazine solution, with added cooling because of the occurring exotherm. The reaction media are gently refluxed for a one hour period. The reflux condenser is then replaced with a Dean-Stark water trap to collect the water by-product. After the theoretical amount of water has been collected, the reaction media are cooled to 25° C. Carbon disulfide (0.5 mole) is then added dropwise over a one hour period with external cooling to maintain the exothermic reaction temperature below 35° C. After the carbon disulfide addition is complete, the temperature is raised to reflux or 115° C. and held for one hour. The solvent is then removed under vacuum. The product may be then polish filtered through a bed of Celite filter aid.

It should be noted that under optimum conditions, the reaction may also be carried out without a solvent.

USE WITH OTHER ADDITIVES

The 5-alkyl-2-thione-1,3,4-thiadiazolidine additives of this invention can be used as either a partial or complete replacement for the zinc dialkyldithiophosphates currently used. They can also be used in combination with other additives typically found in lubricating oils, as well as with other ashless, antiwear additives. The thione thiadiazolidine additives of the present invention may also display synergistic effects with these other typical additives to improve oil performance properties. The additives typically found in lubricating oils are, for example, dispersants, detergents, corrosion/rust inhibitors, antioxidants, antiwear agents, antifoamants, friction modifiers, seal swell agents, demulsifiers, VI improvers, pour point depressants, and the like. See, for example, U.S. Pat. No. 5,498,809 for a description of useful lubricating oil composition additives, the disclosure of which is incorporated herein by reference in its entirety. Examples of dispersants include polyisobutylene succinimides, polyisobutylene succinate esters, Mannich Base ashless dispersants, and the like. Examples of detergents include metallic phenates, metallic sulfurized phenates, metallic sulfonates, metallic alkyl salicylates, and the like. Examples of antioxidants include alkylated diphenylamines, N-alkylated phenylenediamines, hindered phenolics, alkylated hydroquinones, hydroxylated thiodiphenyl ethers, alkylidenebisphenols, oil soluble copper compounds, and the like. Examples of antiwear additives that can be used in combination with the additives of the present invention include organo borates, organo phosphites, organic sulfur-containing compounds, zinc dialkyldithiophosphates, zinc diaryldithiophosphates, phosphosulfurized hydrocarbons, and the like. The following are exemplary of such additives and are commercially available from The Lubrizol Corporation: Lubrizol 677A, Lubrizol 1095, Lubrizol 1097, Lubrizol 1360, Lubrizol 1395, Lubrizol 5139, and Lubrizol 5604, among others. Examples of friction modifiers include fatty acid esters and amides, organo molybdenum sulfurized and unsulfurized compounds, molybdenum dialkylthiocarbamates, molybdenum dialkyl dithiophosphates, and the like. An example of an antifoamant is polysiloxane, and the like. An example of a rust inhibitor is a polyoxyalkylene polyol, and the like. Examples of VI improvers include olefin copolymers and dispersant olefin copolymers, and the like. An example of a pour point depressant is polymethacrylate, and the like.

Representative conventional antiwear agents that can be used include, for example, the zinc dialkyl dithiophosphates and the zinc diaryl dithiophosphates.

Suitable phosphates include dihydrocarbyl dithiophosphates, wherein the hydrocarbyl groups contain an average of at least 3 carbon atoms. Particularly useful are metal salts of at least one dihydrocarbyl dithiophosphoric acid wherein the hydrocarbyl groups contain an average of at least 3 carbon atoms. The acids from which the dihydrocarbyl dithiophosphates can be derived can be illustrated by acids of the formula:

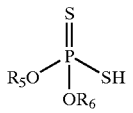

wherein $R_5$ and $R_6$ are the same or different and are alkyl, cycloalkyl, aralkyl, alkaryl or substituted substantially hydrocarbon radical derivatives of any of the above groups, and wherein the $R_5$ and $R_6$ groups in the acid each have, on average, at least 3 carbon atoms. By "substantially hydrocarbon" is meant radicals containing substituent groups (e.g., 1 to 4 substituent groups per radical moiety) such as ether, ester, nitro, or halogen that do not materially affect the hydrocarbon character of the radical.

Specific examples of suitable $R_5$ and $R_6$ radicals include isopropyl, isobutyl, n-butyl, sec-butyl, n-hexyl, heptyl, 2-ethylhexyl, diisobutyl, isooctyl, decyl, dodecyl, tetradecyl, hexadecyl, octadecyl, butylphenyl,o,p-depentylphenyl, octylphenyl, polyisobutene-(molecular weight 350)-substituted phenyl, tetrapropylene-substituted phenyl, beta-octylbutylnaphthyl, cyclopentyl, cyclohexyl, phenyl, chlorophenyl, o-dichlorophenyl, bromophenyl, naphthenyl, 2-methylcyclohexyl, benzyl, chlorobenzyl, chloropentyl, dichlorophenyl, nitrophenyl, dichlorodecyl and xenyl radicals. Alkyl radicals having from about 3 to about 30 carbon atoms and aryl radicals having from about 6 to about 30 carbon atoms are preferred. Particularly preferred $R_5$and $R_6$ radicals are alkyl of from 4 to 18 carbon atoms.

The phosphorodithioic acids are readily obtainable by the reaction of phosphorus pentasulfide and an alcohol or phenol. The reaction involves mixing, at a temperature of about 20° C. to 200° C., 4 moles of the alcohol or phenol with one mole of phosphorus pentasulfide. Hydrogen sulfide is liberated as the reaction takes place. Mixtures of alcohols, phenols, or both can be employed, e.g., mixtures of $C_3$ to $C_{30}$ alcohols, $C_6$ to $C_{30}$ aromatic alcohols, etc.

The metals useful to make the phosphate salts include Group I metals, Group II metals, aluminum, lead, tin, molybdenum, manganese, cobalt, and nickel. Zinc is the preferred metal. Examples of metal compounds that can be reacted with the acid include lithium oxide, lithium hydroxide, lithium carbonate, lithium pentylate, sodium oxide, sodium hydroxide, sodium carbonate, sodium methylate, sodium propylate, sodium phenoxide, potassium oxide, potassium hydroxide, potassium carbonate, potassium methylate, silver oxide, silver carbonate, magnesium oxide, magnesium hydroxide, magnesium carbonate, magnesium ethylate, magnesium propylate, magnesium phenoxide, calcium oxide, calcium hydroxide, calcium carbonate, calcium methylate, calcium propylate, calcium pentylate, zinc oxide, zinc hydroxide, zinc carbonate, zinc propylate, strontium oxide, strontium hydroxide, cadmium oxide, cadmium hydroxide, cadmium carbonate, cadmium ethylate, barium oxide, barium hydroxide, barium hydrate, barium carbonate, barium ethylate, barium pentylate, aluminum oxide, aluminum propylate, lead oxide, lead hydroxide, lead carbonate, tin oxide, tin butylate, cobalt oxide, cobalt hydroxide, cobalt carbonate, cobalt pentylate, nickel oxide, nickel hydroxide, and nickel carbonate.

In some instances, the incorporation of certain ingredients, particularly carboxylic acids or metal carboxylates, such as, small amounts of the metal acetate or acetic acid, used in conjunction with the metal reactant will facilitate the reaction and result in an improved product. For example, the use of up to about 5% of zinc acetate in combination with the required amount of zinc oxide facilitates the formation of a zinc phosphorodithioate.

The preparation of metal phosphorodithioates is well known in the art and is described in a large number of issued patents, including U.S. Pat. Nos. 3,293,181; 3,397,145; 3,396,109 and 3,442,804, the disclosures of which are hereby incorporated by reference. Also useful as antiwear additives are amine derivatives of dithiophosphoric acid compounds, such as are described in U.S. Pat. No. 3,637,499, the disclosure of which is hereby incorporated by reference in its entirety.

The zinc salts are most commonly used as antiwear additives in lubricating oil in amounts of 0.1 to 10, preferably 0.2 to 2, wt. %, based upon the total weight of the lubricating oil composition. They may be prepared in accordance with known techniques by first forming a dithiophosphoric acid, usually by reaction of an alcohol or a phenol with $P_2S_5$ and then neutralizing the dithiophosphoric acid with a suitable zinc compound.

Mixtures of alcohols can be used, including mixtures of primary and secondary alcohols, secondary generally for imparting improved antiwear properties and primary for thermal stability. Mixtures of the two are particularly useful. In general, any basic or neutral zinc compound could be used, but the oxides, hydroxides, and carbonates are most generally employed. Commercial additives frequently contain an excess of zinc owing to use of an excess of the basic zinc compound in the neutralization reaction.

The zinc dihydrocarbyl dithiophosphates (ZDDP) are oil soluble salts of dihydrocarbyl esters of dithiophosphoric acids and can be represented by the following formula:

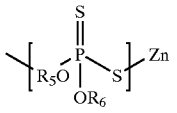

wherein $R_5$ and $R_6$ are as described in connection with the previous formula.

Especially preferred additives for use in the practice of the present invention include alkylated diphenylamines, hindered alkylated phenols, hindered alkylated phenolic esters, and molybdenum dithiocarbamates.

LUBRICANT COMPOSITIONS

Compositions, when they contain these additives, are typically blended into the base oil in amounts such that the additives therein are effective to provide their normal attendant functions. Representative effective amounts of such additives are illustrated in TABLE 1.

TABLE 1

| Additives | Preferred Weight % | More Preferred Weight % |
|---|---|---|
| V.I. Improver | 1–12 | 1–4 |
| Corrosion Inhibitor | 0.01–3 | 0.01–1.5 |
| Oxidation Inhibitor | 0.01–5 | 0.01–1.5 |
| Dispersant | 0.01–10 | 0.01–5 |
| Lube Oil Flow Improver | 0.01–2 | 0.01–1.5 |
| Detergent/Rust Inhibitor | 0.01–6 | 0.01–3 |
| Pour Point Depressant | 0.01–1.5 | 0.01–0.5 |
| Antifoaming Agent | 0.001–0.1 | 0.001–0.01 |
| Antiwear Agent | 0.001–5 | 0.001–1.5 |
| Seal Swellant | 0.1–8 | 01.–4 |
| Friction Modifier | 0.01–3 | 0.01–1.5 |
| Lubricating Base Oil | Balance | Balance |

When other additives are employed, it may be desirable, although not necessary, to prepare additive concentrates comprising concentrated solutions or dispersions of the subject additives of this invention, together with one or more of said other additives (said concentrate when constituting an additive mixture being referred to herein as an additive-package) whereby several additives can be added simultaneously to the base oil to form the lubricating oil composition. Dissolution of the additive concentrate into the lubricating oil can be facilitated by solvents and/or by mixing accompanied by mild heating, but this is not essential. The concentrate or additive-package will typically be formulated to contain the additives in proper amounts to provide the desired concentration in the final formulation when the additive-package is combined with a predetermined amount of base lubricant. Thus, the subject additives of the present invention can be added to small amounts of base oil or other compatible solvents along with other desirable additives to form additive-packages containing active ingredients in collective amounts of, typically, from about 2.5 to about 90 percent, preferably from about 15 to about 75 percent, and more preferably from about 25 percent to about 60 percent by weight additives in the appropriate proportions with the remainder being base oil. The final formulations can typically employ about 1 to 20 weight percent of the additive-package with the remainder being base oil.

All of the weight percentages expressed herein (unless otherwise indicated) are based on the active ingredient (AI) content of the additive, and/or upon the total weight of any additive-package, or formulation, which will be the sum of the AI weight of each additive plus the weight of total oil or diluent.

In general, the lubricant compositions of the invention contain the additives in a concentration ranging from about 0.05 to about 30 weight percent. A concentration range for the additives ranging from about 0.1 to about 10 weight percent based on the total weight of the oil composition is preferred. A more preferred concentration range is from about 0.2 to about 5 weight percent. Oil concentrates of the additives can contain from about 1 to about 75 weight percent of the additive reaction product in a carrier or diluent oil of lubricating oil viscosity.

In general, the additives of the present invention are useful in a variety of lubricating oil base stocks. The lubricating oil base stock is any natural or synthetic lubricating oil base stock fraction having a kinematic viscosity at 100° C. of about 2 to about 200 cSt, more preferably about 3 to about 150 cSt, and most preferably about 3 to about 100 cSt. The lubricating oil base stock can be derived from natural lubricating oils, synthetic lubricating oils, or mixtures thereof Suitable lubricating oil base stocks include base stocks obtained by isomerization of synthetic wax and wax, as well as hydrocrackate base stocks produced by hydrocracking (rather than solvent extracting) the aromatic and polar components of the crude. Natural lubricating oils include animal oils, such as, lard oil, vegetable oils (e.g., canola oils, castor oils, sunflower oils), petroleum oils, mineral oils, and oils derived from coal or shale.

Synthetic oils include hydrocarbon oils and halo-substituted hydrocarbon oils, such as, polymerized and interpolymerized olefins, alkylbenzenes, polyphenyls, alkylated diphenyl ethers, alkylated diphenyl sulfides, as well as their derivatives, analogs, homologues, and the like. Synthetic lubricating oils also include alkylene oxide polymers, interpolymers, copolymers, and derivatives thereof, wherein the terminal hydroxyl groups have been modified by esterification, etherification, etc.

Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers.

Silicon-based oils (such as the polyalkyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, poly $\alpha$-olefins, and the like.

The lubricating oil may be derived from unrefined, refined, rerefined oils, or mixtures thereof Unrefined oils are obtained directly from a natural source or synthetic source (e.g., coal, shale, or tar and bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to unrefined oils, except that refined oils have been treated in one or more purification steps to improve one or more properties. Suitable purification techniques include distillation, hydrotreating, dewaxing, solvent extraction, acid or base extraction, filtration, percolation, and the like, all of which are well-known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst. Natural waxes are typically the slack waxes recovered by the solvent dewaxing of mineral oils; synthetic waxes are typically the wax produced by the Fischer-Tropsch process. The resulting isomerate product is typically subjected to solvent dewaxing and fractionation to recover various fractions having a specific viscosity range. Wax isomerate is also characterized by possessing very high viscosity indices, generally having a VI of at least 130, preferably at least 135 or higher and, following dewaxing, a pour point of about −20° C. or lower.

The additives of the present invention are especially useful as components in many different lubricating oil compositions. The additives can be included in a variety of oils with lubricating viscosity, including natural and synthetic lubricating oils and mixtures thereof The additives can be included in crankcase lubricating oils for spark-ignited and compression-ignited internal combustion engines. The compositions can also be used in gas engine lubricants, turbine lubricants, automatic transmission fluids, gear lubricants, compressor lubricants, metal-working lubricants, hydraulic fluids, and other lubricating oil and grease compositions. The additives can also be used in motor fuel compositions.

The advantages and the important features of the present invention will be more apparent from the following examples.

EXAMPLES

Four-Ball AntiWear Testing

The antiwear properties of the thiadiazolidines of the present invention in a fully formulated lubricating oil were determined in the Four-Ball Wear Test under the ASTM D 4172 test conditions. The fully formulated lubricating oils tested also contained 1 weight percent cumene hydroperoxide to help simulate the environment within a running engine. The additives were tested for effectiveness in a motor oil formulation (See description in Table 2) and compared to identical formulations with and without any zinc dialkyldithiophosphate. In Table 3, the numerical value of the test results (Average Wear Scar Diameter, mm) decreases with an increase in effectiveness.

TABLE 2

SAE 10W-30 Motor Oil Formulations

| Component | Formulation A (wt %) |
|---|---|
| Solvent Neutral 100 | 22.8 |
| Solvent Neutral 150 | 60 |
| Succinimide Dispersant | 7.5 |
| Overbased Calcium Phenate Detergent | 2.0 |
| Neutral Calcium Sulfonate Detergent | 0.5 |
| Rust Inhibitor | 0.1 |
| Antioxidant | 0.5 |
| Pour Point Depressant | 0.1 |
| OCP VI Improver | 5.5 |
| Antiwear Additive[1] | 1.0 |

[1]In the case of No antiwear additive in Table 2, solvent neutral 100 is put in its place at 1.0 weight percent.

TABLE 3

Four-Ball Wear Results

| Compound at 1.0 Weight Percent | Wear Scar Diameter, mm |
|---|---|
| 5-(1-ethylpentyl)-3-methyl-2-thione-1,3,4-thiadiazolidine | 0.61 |
| 5-undecyl-3-methyl-2-thione-1,3,4-thiadiazolidine | 0.57 |
| 5-heptyl-3-methyl-2-thione-1,3,4-thiadiazolidine | 0.73 |
| 5-nonyl-5-methyl-3-methyl-2-thione-1,3,4-thiadiazolidine | 0.54 |
| 5-hexyl-5-methyl-3-methyl-2-thione-1,3,4-thiadiazolidine | 0.54 |
| 5-(1-phenylethyl)-3-methyl-2-thione-1,3,4-thiadiazolidine | 0.51 |
| 5-(2-phenylethyl)-5-methyl-3-methyl-2-thione-1,3,4-thiadiazolidine | 0.52 |
| No anti-wear additive[1] | 0.73 |

TABLE 3-continued

Four-Ball Wear Results

| Compound at 1.0 Weight Percent | Wear Scar Diameter, mm |
|---|---|
| Zinc dialkyldithiophosphate (1.0 wt %) | 0.50 |
| Zinc dialkyldithiophosphate (0.5 wt %) | 0.70 |

[1]In the case of No anti-wear additive in Table 3, solvent neutral 100 is put in its place at 1.0 weight percent.

Cameron-Plint TE77 High Frequency Friction Machine Anti-wear Testing

Another test used to determine the anti-wear properties of these products is the Cameron-Plint Anti-wear test based on a sliding ball on a plate. The specimen parts (6 mm diameter AISI 52100 steel ball of 800±20 kg/mm$^2$ hardness and hardened ground NSOH B01 gauge plate of RC 60/0.4 micron) are rinsed and then sonicated for 15 minutes with technical grade hexanes. This procedure is repeated with isopropyl alcohol, The specimens are dried with nitrogen and set into the TE77. The oil bath is filled with 10 mL of sample. The test is run at a 30 Hertz Frequency, 100 Newton Load, 2–35 mm Amplitude. The test starts with the specimens and oil at room temperature. Immediately, the temperature is ramped over 15 minutes to 50° C., where it dwells for 15 minutes. The temperature is then ramped over 15 minutes to 100° C., where it dwells for 45 minutes. A third temperature ramp over 15 minutes to 150° C. is followed by a final dwell at 150° C. for 15 minutes. The total length of the test is 2 hours. At the end of the test, the wear scar diameter on the 6 mm ball is measured using a Leica StereoZoom® Stereomicroscope and a Mitutoyo 164 series Digimatic Head.

In the Examples below, the fully formulated lubricating oils tested contained 1 wt. % cumene hydroperoxide to help simulate the environment within a running engine. The test additive was blended at 1.0 wt. % in a fully formulated SAE 5W-20 Prototype GF4 Motor Oil formulation containing no ZDDP. The additives were tested for effectiveness in this motor oil formulation (See description in Table 4) and compared to identical formulations with and without any zinc dialkyldithiophosphate. In Table 4 the numerical value of the test results (Ball Wear Scar Diameter, Plate Scar Width, and Plate Scar Depth) decreases with an increase in effectiveness.

TABLE 4

Cameron-Plint Wear Test

| Additive at 1.0 Weight Percent | Ball Scar (mm) | Plate Scar Width (mm) | Plate Scar Depth (mm) |
|---|---|---|---|
| 5-(1-ethylpentyl)-3-methyl-2-thione-1,3,4-thiadiazolidine | 0.44 | 0.75 | 1.43 |
| 5-nonyl-5-methyl-3-methyl-2-thione-1,3,4-thiadiazolidine | 0.34 | 0.83 | 1.43 |
| No anti-wear additive[1] | 0.66 | 0.74 | 15 05 |
| Zinc dialkyldithiophosphate (1.0 wt %) | 0.39 | 0.72 | 1.83 |
| Zinc dialkyldithiophosphate (0.5 wt %) | 0.62 | 0.76 | 14.77 |

[1]In the case of No anti-wear additive in Table 4, solvent neutral 100 is put in its place at 1.0 weight percent.

In view of the many changes and modifications that can be made without departing from principles underlying the invention, reference should be made to the appended claims for an understanding of the scope of the protection to be afforded the invention.

What is claimed is:

1. A composition comprising:

(A) a lubricant, and (B) at least one compound of the formula:

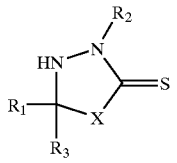

wherein $R_1$ is a hydrocarbon or functionalized hydrocarbon of from 1 to 30 carbon atoms, $R_2$ is selected from the group consisting of hydrocarbon or functionalized hydrocarbons of from 1 to 30 carbon atoms, and $R_3$ is selected from the group consisting of hydrocarbon or functionalized hydrocarbons of from 1 to 30 carbon atoms and hydrogen, or $R_1$ and $R_3$ are fused together as part of a spiro cyclic alkyl group $CH_2(CH_2)_nCH_2$, where n=1–4, and X is oxygen, sulfur or nitrogen.

2. The composition of claim 1 wherein at least one of $R_1$, $R_2$, and $R_3$ is a hydrocarbon that is a straight chain alkyl, a branched chain alkyl, an alkyl in combination with a cyclic structure, an alkylaryl, a fully saturated hydrocarbon chain, or a partially unsaturated hydrocarbon chain.

3. The composition of claim 1 wherein $R_1$ is an alkyl chain of from 1 to 10 carbon atoms.

4. The composition of claim 3 wherein each of $R_1$ and $R_3$ is an alkyl chain of from 1 to 10 carbon atoms.

5. The composition of claim 1 wherein $R_1$ is selected from the group consisting of 1-ethylpentyl, dodecyl, octyl, and heptyl.

6. The composition of claim 5 wherein $R_3$ is methyl.

7. The composition of claim 1 wherein at least one of $R_1$,$R_2$, and $R_3$ is a functionalized hydrocarbon chain of from 1 to 30 linear carbon atoms containing at least one member selected from the group consisting of ether oxygen, sulfide sulfur, ester, amide, and amine nitrogen within the chain.

8. The composition of claim 1 wherein the compound (B) of the formula is present in a concentration in the range of from about 0.01 to about 10 wt %.

9. The composition of claim 1 further comprising at least one additive selected from the group consisting of dispersants, detergents, corrosion/rust inhibitors, zinc dialkyldithiophosphates, VI improvers, pour point depressants, antioxidants, and friction modifiers.

10. The composition of claim 1 further comprising at least one member selected from the group consisting of zinc dialkyldithiophosphates, zinc diaryldithiophosphates, and mixtures thereof.

11. The composition of claim 1 wherein $R_1$ and $R_3$ are fused together as part of a spiro cyclic alkyl group $CH_2(CH_2)_nCH_2$, where n=1–4.

12. The composition of claim 1 further comprising at least one additive selected from the group consisting of alkylated diphenylamines, hindered alkylated phenols, hindered alkylated phenolic esters, and molybdenum dithiocarbamates.

13. The composition of claim 1 further comprising at least one additive selected from the group consisting of metallic phenates, metallic sulfurized phenates, metallic sulfonates, and metallic alkyl salicylates.

14. The composition of claim 1 wherein the lubricant is a lubricating oil.

15. The composition of claim 14 wherein at least one of $R_1$, $R_2$, and $R_3$ is a hydrocarbon that is a straight chain alkyl, a branched chain alkyl, an alkyl in combination with a cyclic structure, an alkylaryl, a fully saturated hydrocarbon chain, or a partially unsaturated hydrocarbon chain.

16. The composition of claim 14 wherein $R_1$ is an alkyl chain of from 1 to 10 carbon atoms.

17. The composition of claim 16 wherein each of $R_1$ and $R_3$ is an alkyl chain of from 1 to 10 carbon atoms.

18. The composition of claim 14 wherein $R_1$ is selected from the group consisting of 1-ethylpentyl, dodecyl, octyl, and heptyl.

19. The composition of claim 18 wherein $R_3$ is methyl.

20. The composition of claim 14 wherein at least one of $R_1$,$R_2$, and $R_3$ is a functionalized hydrocarbon chain of from 1 to 30 linear carbon atoms containing at least one member selected from the group consisting of ether oxygen, sulfide sulfur, ester, amide, and amine nitrogen within the chain.

21. The composition of claim 14 further comprising at least one additive selected from the group consisting of dispersants, detergents, corrosion/rust inhibitors, zinc dialkyldithiophosphates, VI improvers, pour point depressants, antioxidants, and friction modifiers.

22. The composition of claim 14 further comprising at least one member selected from the group consisting of zinc dialkyldithiophosphates, zinc diaryldithiophosphates, and mixtures thereof.

23. The composition of claim 14 wherein $R_1$ and $R_3$ are fused together as part of a spiro cyclic alkyl group $CH_2(CH_2)_nCH_2$, where n=1–4.

24. The composition of claim 14 further comprising at least one additive selected from the group consisting of alkylated diphenylamines, hindered alkylated phenols, hindered alkylated phenolic esters, and molybdenum dithiocarbamates.

25. The composition of claim 14 further comprising at least one additive selected from the group consisting of metallic phenates, metallic sulfurized phenates, metallic sulfonates, and metallic alkyl salicylates.

* * * * *